US010074324B2

(12) United States Patent
Cho

(10) Patent No.: US 10,074,324 B2
(45) Date of Patent: Sep. 11, 2018

(54) LIQUID CRYSTAL DISPLAY PANEL AND LIQUID CRYSTAL DISPLAY DEVICE

(71) Applicant: SAMSUNG DISPLAY CO., LTD., Yongin-si, Gyeonggi-do (KR)

(72) Inventor: Dong-beom Cho, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 89 days.

(21) Appl. No.: 15/136,234

(22) Filed: Apr. 22, 2016

(65) Prior Publication Data

US 2017/0025078 A1 Jan. 26, 2017

(30) Foreign Application Priority Data

Jul. 20, 2015 (KR) ..... 10-2015-0102656

(51) Int. Cl.
*G09G 3/18* (2006.01)
*G09G 3/36* (2006.01)

(52) U.S. Cl.
CPC ..... *G09G 3/3614* (2013.01); *G09G 3/3648* (2013.01); *G09G 2300/0426* (2013.01); *G09G 2310/0272* (2013.01)

(58) Field of Classification Search
CPC ..... G09G 3/36–3/3696
See application file for complete search history.

(56) References Cited

U.S. PATENT DOCUMENTS

2002/0030653 A1* 3/2002 Cairns ..... G09G 3/2011 345/87
2006/0164367 A1* 7/2006 An ..... G09G 3/3648 345/98

(Continued)

FOREIGN PATENT DOCUMENTS

KR 10-0938976 B1 1/2010
KR 10-2011-0064960 A 6/2011

(Continued)

OTHER PUBLICATIONS

Patent Abstract for Korean Patent Publication No. 10-2004-0062044 A, Jul. 7, 2004 Corresponding to Korean Patent No. 10-0938976 B1, Jan. 26, 2010, 1 Page.

(Continued)

*Primary Examiner* — Hang Lin
(74) *Attorney, Agent, or Firm* — Lewis Roca Rothgerber Christie LLP

(57) ABSTRACT

A liquid crystal display device includes m gate lines, n data lines, and m×n pixels each connected to a corresponding gate line, each connected to a corresponding data line, and each including a first sub-pixel and a second sub-pixel, wherein the first sub-pixel includes a first liquid crystal capacitor, and a first transistor configured to receive a data signal from the corresponding data line, and configured to apply the data signal to the first liquid crystal capacitor, and wherein the second sub-pixel includes a second liquid crystal capacitor, a second transistor configured to apply the data signal to the second liquid crystal capacitor, and a third transistor configured to apply a storage voltage, which is configured to swing between a first electric potential level and a second electric potential level that is greater than the first electric potential level, to the second liquid crystal capacitor.

12 Claims, 9 Drawing Sheets

(56) References Cited

U.S. PATENT DOCUMENTS

| | | | | |
|---|---|---|---|---|
| 2013/0182018 | A1* | 7/2013 | Jeong | G09G 3/3659<br>345/690 |
| 2015/0185533 | A1* | 7/2015 | Kim | G09G 3/3648<br>349/41 |

FOREIGN PATENT DOCUMENTS

| | | | |
|---|---|---|---|
| KR | 10-2013-0042242 | A | 4/2013 |
| KR | 10-2013-0055345 | A | 5/2013 |
| KR | 10-2013-0104733 | A | 9/2013 |
| KR | 10-1432715 | B1 | 8/2014 |

OTHER PUBLICATIONS

Patent Abstract for Korean Patent Publication No. 10-2009-0080427 A, Jul. 24, 2009 Corresponding to Korean Patent No. 10-1432715 B1, Aug. 21, 2014, 1 Page.

* cited by examiner $F_{K+1}$

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

$F_K$

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

FIG. 6A

LIQUID CRYSTAL DISPLAY PANEL AND LIQUID CRYSTAL DISPLAY DEVICE

CROSS-REFERENCE TO RELATED APPLICATION

This application claims priority to, and the benefit of, Korean Patent Application No. 10-2015-0102656, filed on Jul. 20, 2015, which is hereby incorporated by reference for all purposes as if fully set forth herein.

BACKGROUND

1. Field

Embodiments of the present disclosure relate to a liquid crystal display panel, a liquid crystal display device having the same, and a liquid crystal display device driven in a vertical alignment mode and in a pixel division mode.

2. Description of the Related Art

In general, a liquid crystal display device controls an intensity of electric field applied to a liquid crystal layer between two substrates to control an amount of light passing through the two substrates, and thus, the liquid crystal display device displays a desired image.

A liquid crystal display device driven in a vertical alignment mode includes liquid crystal molecules that have a negative dielectric constant anisotropy and that are aligned in a homeotropic alignment. In recent years, the liquid crystal display device driven in the vertical alignment mode is widely used due to having a high contrast ratio and a wide viewing angle.

A driving method for the liquid crystal display device is classified into a frame inversion driving method, a line inversion driving method, and a dot inversion driving method, according to a polarity of a data voltage applied to data lines. In the case of the frame inversion driving method, image data applied to data lines in one frame period have the same polarity. In the line inversion driving method, the polarity of the image data applied to the data lines is inverted every pixel row. In the dot inversion driving method, the polarity of the image data applied to the data line is inverted every pixel (e.g., every row and column).

SUMMARY

Embodiments of the present disclosure provide a liquid crystal display panel capable of preventing a horizontal line defect occurring due to an IR drop, and provide a liquid crystal display device having the liquid crystal display panel.

Embodiments of the inventive concept provide a liquid crystal display device including m gate lines (m being a positive integer), n data lines (n being a positive integer), and m×n pixels each connected to a corresponding gate line of the m gate lines, each connected to a corresponding data line of the n data lines, and each including a first sub-pixel and a second sub-pixel, wherein the first sub-pixel includes a first liquid crystal capacitor, and a first transistor configured to receive a data signal from the corresponding data line, and configured to apply the data signal to the first liquid crystal capacitor, and wherein the second sub-pixel includes a second liquid crystal capacitor, a second transistor configured to apply the data signal to the second liquid crystal capacitor, and a third transistor configured to apply a storage voltage, which is configured to swing between a first electric potential level and a second electric potential level that is greater than the first electric potential level, to the second liquid crystal capacitor.

Each of the first, second, and third transistors may include a control electrode connected to the corresponding gate line.

The third transistor may be connected to the second transistor in series.

The first sub-pixel may further include a first storage capacitor, and the second sub-pixel may further include a second storage capacitor.

The first storage capacitor may include a first pixel electrode configured to receive the data signal, and a first storage electrode configured to receive the storage voltage, and the second storage capacitor may include a second pixel electrode configured to receive the data signal, and a second storage electrode configured to receive the storage voltage.

The data signal has a polarity inverted every frame period.

The data signal applied to the m×n pixels at one period for every frame period has a same polarity.

The storage voltage swings at one period for every frame period.

The one period comprises an earlier period in which the third transistor applies the storage voltage having the first electric potential level to the second liquid crystal capacitor and a later period in which the third transistor applies the storage voltage having the second electric potential level to the second liquid crystal capacitor.

The m×n pixels may be divided into m pixel rows and n pixel columns, the m pixel rows being configured to receive the data signals, which may be configured to be line-inverted every frame period.

The storage voltage may be configured to swing at each of m periods for every frame period.

Each of the m periods may include an earlier period in which the third transistor is configured to apply the storage voltage having the first electric potential level to the second liquid crystal capacitor, and a later period in which the third transistor is configured to apply the storage voltage having the second electric potential level to the second liquid crystal capacitor.

The m×n pixels may be configured to receive the data signals, which may be configured to be dot-inverted every frame period.

The storage voltage may be configured to swing at m×n periods for every frame period.

Each of the m×n periods may include an earlier period in which the third transistor is configured to apply the storage voltage having the first electric potential level to the second liquid crystal capacitor, and a later period in which the third transistor is configured to apply the storage voltage having the second electric potential level to the second liquid crystal capacitor.

Embodiments of the inventive concept provide a liquid crystal display device including a liquid crystal display panel including m gate lines (m being a positive integer), n data lines (n being a positive integer), m×n pixels, each being connected to a corresponding gate line of the m gate lines, each being connected to a corresponding data line of the n data lines, and each including a first sub-pixel and a second sub-pixel, a gate driver configured to apply gate signals to the liquid crystal display panel, and a data driver configured to apply data signals to the liquid crystal display panel, wherein the first sub-pixel includes a first liquid crystal capacitor, and a first transistor configured to receive a data signal from the corresponding data line, and configured to apply the data signal to the first liquid crystal capacitor, and wherein the second sub-pixel includes a second liquid crystal capacitor, a second transistor configured to apply the data signal to the second liquid crystal capacitor, and a third transistor configured to apply a storage voltage, which is configured to swing between a first electric potential level and a second electric potential level that is greater than the first electric potential level, to the second liquid crystal capacitor.

Each of the first, second, and third transistors may include a control electrode connected to the corresponding gate line.

The data driver may be configured to apply the data signal inverted every frame period to each of the n data lines.

Embodiments of the inventive concept provide a liquid crystal display panel including m gate lines (m being a positive integer), n data lines (n being a positive integer), and m×n pixels, one of the m×n pixels including a first sub-pixel and a second sub-pixel, wherein the first sub-pixel includes a first transistor including a first control electrode, a first input electrode, and a first output electrode, wherein the second sub-pixel includes a second transistor including a second control electrode, a second input electrode, and a second output electrode, and a third transistor including a third control electrode, a third input electrode connected to the second output electrode, and a third output electrode, wherein the first, second, and third control electrodes are connected to an i-th gate line of the m gate lines (i being a positive integer), wherein the first and second input electrodes are connected to a j-th data line of the n data lines (j being a positive integer), and wherein an electrical signal that is configured to be applied to the third output electrode is configured to swing between a first electric potential value and a second electric potential value that is different from the first electric potential value.

According to the above, the horizontal line defect due to the IR drop, which is generated in the storage line of the liquid crystal display device, may be reduced or prevented. Thus, the liquid crystal display device may display the image having improved display quality.

BRIEF DESCRIPTION OF THE DRAWINGS

The above and other aspects of embodiments of the present disclosure will become readily apparent by reference to the following detailed description, when considered in conjunction with the accompanying drawings, wherein:

FIG. 6A is a view showing a dot inversion driving scheme of a display device according to an exemplary embodiment of the present disclosure.

DETAILED DESCRIPTION

Figure 1:
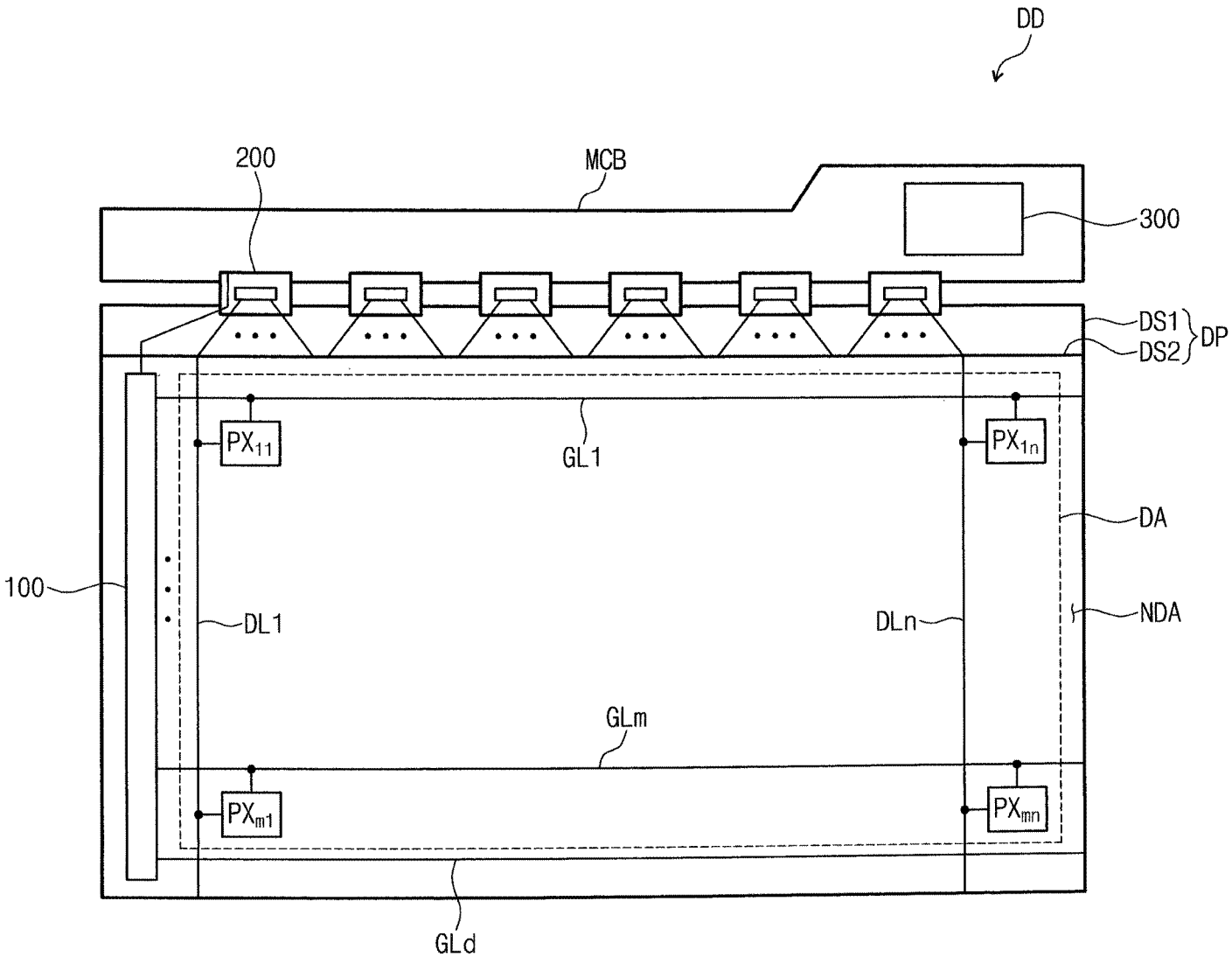
FIG. 1 is a block diagram showing a display device according to an exemplary embodiment of the present disclosure.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
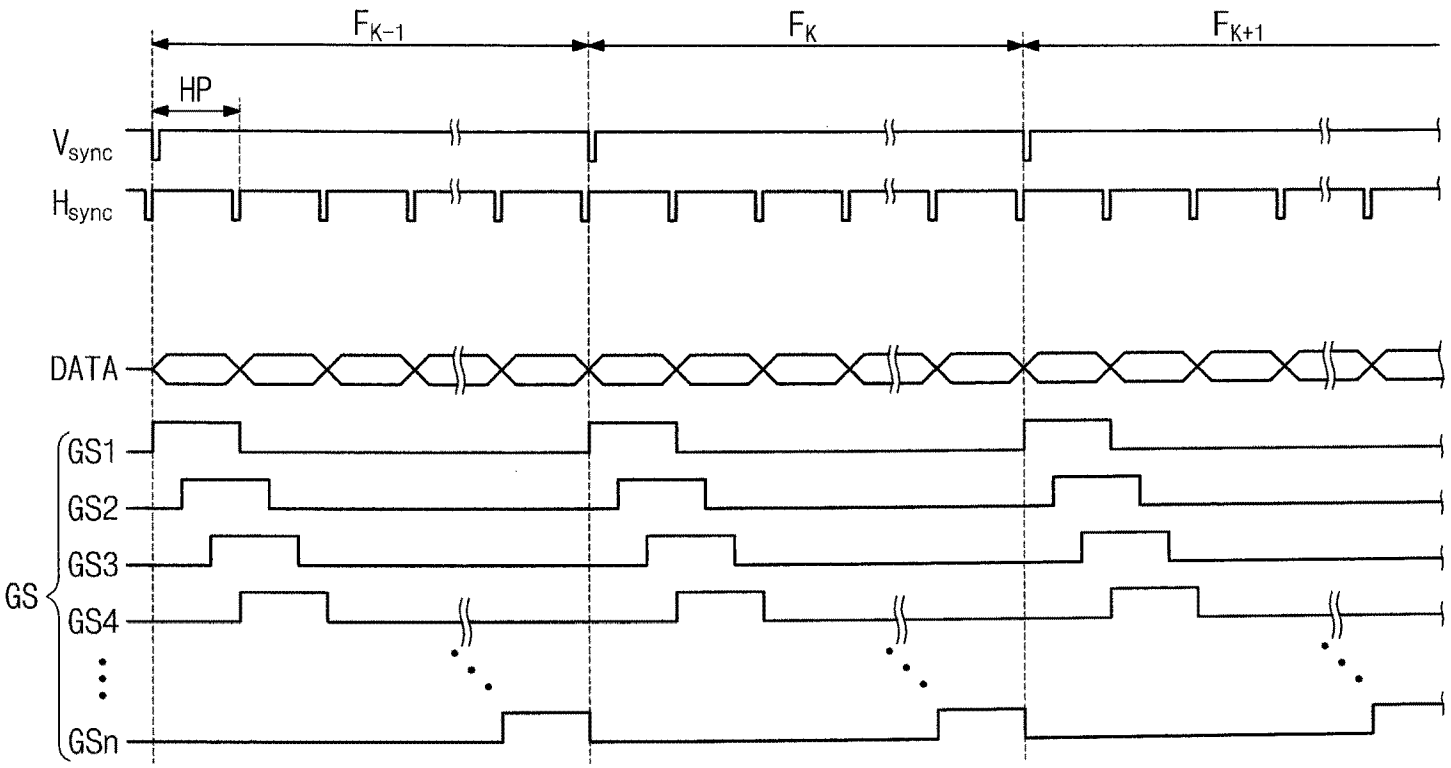
FIG. 2 is a timing diagram showing signals of a display device according to an exemplary embodiment of the present disclosure.

FIG. 1 is a block diagram showing a liquid crystal display device DD according to an exemplary embodiment of the present disclosure, and FIG. 2 is a timing diagram showing signals of the liquid crystal display device DD according to an exemplary embodiment of the present disclosure.

Referring to FIG. 1, the liquid crystal display device DD includes a liquid crystal display panel DP, a gate driver 100, a data driver 200, and a signal controller 300.

The liquid crystal display device DD including the liquid crystal display panel DP may further include a polarizer and a backlight unit.

The liquid crystal display panel DP includes a first substrate DS1, a second substrate DS2 spaced from the first substrate DS1, and a liquid crystal layer between the first substrate DS1 and the second substrate DS2. When viewed in a plan view, the liquid crystal display panel DP includes a display area DA in which m×n pixels $PX_{11}$ to $PX_{mn}$ are arranged (e.g., arranged in m rows and in n columns), and includes a non-display area NDA surrounding the display area DA.

The liquid crystal display panel DP includes m gate lines GL1 to GLm on the first substrate DS1, and n data lines DL1 to DLn on the first substrate DS1 and crossing the gate lines GL1 to GLm. The m gate lines GL1 to GLm are connected to the gate driver 100. The n data lines DL1 to DLn are connected to the data driver 200. FIG. 1 shows a portion of the m gate lines GL1 to GLm and a portion of the n data lines DL1 to DLn. In addition, the liquid crystal display panel DP may further include a dummy gate line GLd in the non-display area NDA on the first substrate DS1.

FIG. 1 shows a portion of the m×n pixels $PX_{11}$ to $PX_{mn}$. Each of the m×n pixels $PX_{11}$ to $PX_{mn}$ is connected to a corresponding gate line of them gate lines GL1 to GLm, and is connected to a corresponding data line of the n data lines DL1 to DLn. However, the dummy gate line GLd is not connected to the pixels $PX_{11}$ to $PX_{mn}$.

The pixels $PX_{11}$ to $PX_{mn}$ may be grouped into a plurality of groups according to colors displayed by the pixels $PX_{11}$ to $PX_{mn}$. Each of the pixels $PX_{11}$ to $PX_{mn}$ displays one of primary colors. The primary colors may include red, green, blue, and white colors, although the present disclosure is not be limited thereto or thereby. That is, the primary colors may further, or instead, include various colors (e.g., yellow, cyan, magenta, etc.).

The gate driver 100 and the data driver 200 receive control signals from the signal controller 300 (e.g., from a timing controller). The signal controller 300 is mounted on a main circuit board MCB. The signal controller 300 may receive image data and control signals from an external graphic controller. The control signals may include a vertical synchronization signal Vsync as a frame distinction signal to distinguish frame periods $F_{k-1}$, $F_k$, and $F_{k+1}$, a horizontal synchronization signal Hsync as a row distinction signal to distinguish horizontal periods HP, and a data enable signal maintained at a high level during a period, in which data are output, to indicate a data input period. The control signals may also include clock signals.

The gate driver 100 generates gate signals GS1 to GSm during the frame periods $F_{k-1}$, $F_k$, and $F_{k+1}$ in response to the control signal (hereinafter, referred to as a gate control signal) provided from the signal controller 300, and applies the gate signals GS1 to GSm to the gate lines GL1 to GLm. The gate signals GS1 to GSm are sequentially output to correspond to the horizontal periods HP. The gate driver 100 may be formed at about the same time as the pixels $PX_{11}$ to $PX_{mn}$ through a thin film process. For instance, the gate driver 100 may be mounted in the non-display area NDA in an ASG (amorphous silicon TFT gate driver circuit) form, or in an OSG (oxide semiconductor TFT gate driver circuit) form. The gate driver 100 of the ASG form or the OSG form may be vulnerable to a horizontal line defect caused by an IR drop because the gate signals GS1 to GSm applied to the gate lines GL1 to GLm partially overlap with each other in time.

Figure 3:
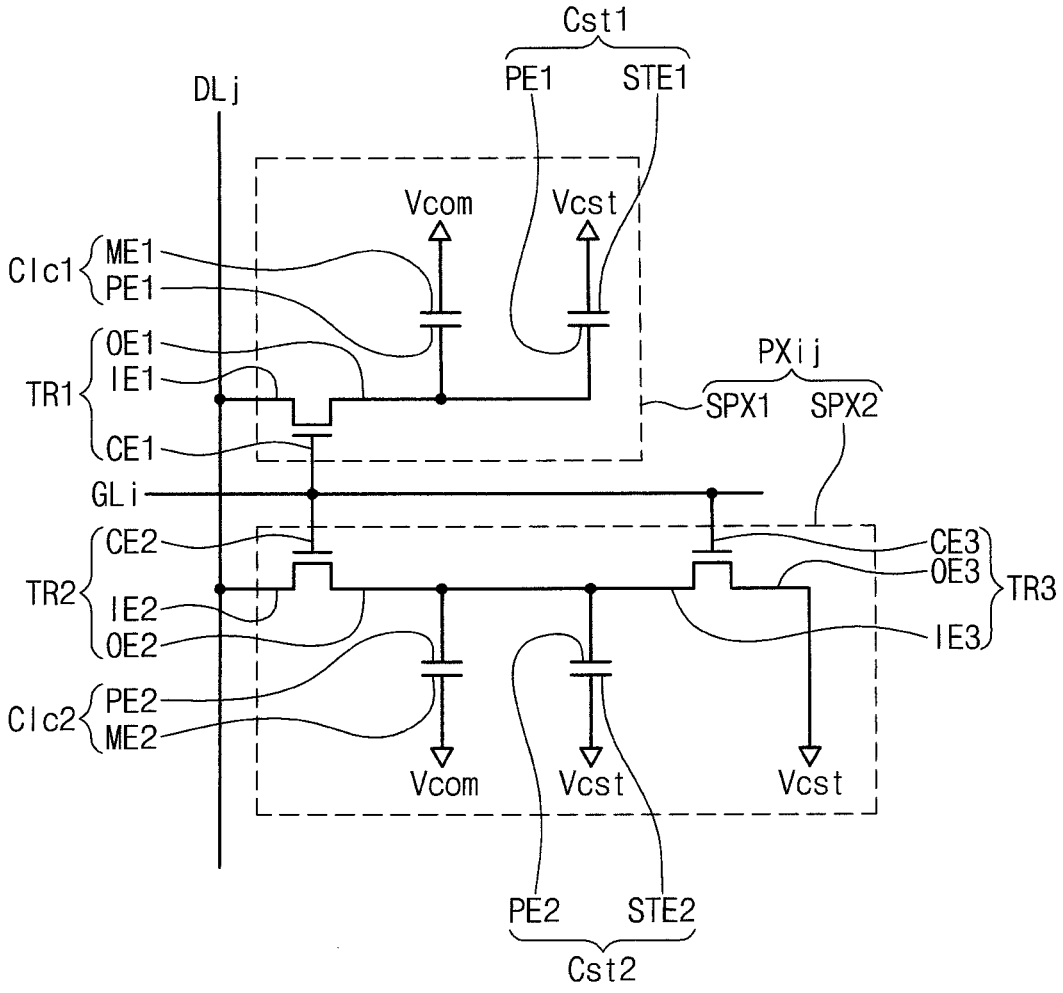
FIG. 3 is an equivalent circuit diagram showing a pixel according to an exemplary embodiment of the present disclosure.

FIG. 3 is an equivalent circuit diagram showing one pixel $PX_{ij}$ of the pixels $PX_{11}$ to $PX_{mn}$ according to an exemplary embodiment of the present disclosure. The pixels $PX_{11}$ to $PX_{mn}$ shown in FIG. 1 have the same structure and function, and thus, only the one pixel $PX_{ij}$ will be described in detail with reference to FIG. 3.

Referring to FIG. 3, the pixel $PX_{ij}$ includes a first sub-pixel SPX1 and a second sub-pixel SPX2.

The first sub-pixel SPX1 includes a first transistor TR1, a first liquid crystal capacitor CM, and a first storage capacitor Cst1.

The first transistor TR1 includes a first control electrode CE1, a first input electrode IE1, and a first output electrode OE1. The first control electrode CE1 is connected to a corresponding gate line GLi. The first input electrode IE1 is connected to a corresponding data line DLj. The first output electrode OE1 is connected to the first liquid crystal capacitor CLc1 and the first storage capacitor Cst1. The first transistor TR1 applies a data signal DATA (see FIG. 2) provided from the data line DLj to the first liquid crystal capacitor Clc1. Here, the data signal DATA corresponds to a data voltage.

The first liquid crystal capacitor Clc1 is formed by a first pixel electrode PE1 and a first common electrode ME1, which face each other such that the liquid crystal layer is therebetween.

The first storage capacitor Cst1 is formed by the first pixel electrode PE1 and a first storage electrode STE1, which overlap each other.

The second sub-pixel SPX2 includes a second transistor TR2, a third transistor TR3, a second liquid crystal capacitor Clc2, and a second storage capacitor Cst2.

The second transistor TR2 includes a second control electrode CE2, a second input electrode IE2, and a second output electrode OE2. The second control electrode CE2 is connected to the gate line GLi, and the second input electrode IE2 is connected to the data line DLj. The second output electrode OE2 is connected to the second liquid crystal capacitor Clc2 and to the second storage capacitor Cst2. The second transistor TR2 applies the data signal DATA provided from the data line DLj to the second liquid crystal capacitor Clc2. Here, the data signal DATA corresponds to the data voltage.

The third transistor TR3 includes a third control electrode CE3, a third input electrode IE3, and a third output electrode OE3. The third control electrode CE3 is connected to the gate line GLi, and the third input electrode IE3 is connected to the second liquid crystal capacitor Clc2 and to the second storage capacitor Cst2. The third output electrode OE3 is applied with a storage voltage Vcst. The third transistor TR3 applies the storage voltage Vcst to the second liquid crystal capacitor Clc2.

The second liquid crystal capacitor Clc2 includes a second pixel electrode PE2 and a second common electrode ME2, which face each other such that the liquid crystal layer is therebetween.

The second storage capacitor Cst2 includes the second pixel electrode PE2 and a second storage electrode STE2, which overlap each other.

The first and second common electrodes ME1 and ME2 receive a common voltage Vcom, and the first and second storage electrodes STE1 and STE2 receive the storage voltage Vcst.

The first, second, and third transistors TR1, TR2, and TR3 are substantially simultaneously turned on in response to the gate signal provided through the gate line GLi. The data voltage is applied to the first sub-pixel SPX1 through the turned-on first transistor TR1. In detail, the data voltage provided through the data line DLj is applied to the first pixel electrode PE1 of the first sub-pixel SPX1 through the turned-on first transistor TR1.

The first liquid crystal capacitor Clc1 is charged with a first pixel voltage corresponding to the data voltage. In detail, the first pixel voltage, which corresponds to a difference in level between the data voltage applied to the first pixel electrode PE1 and the common voltage Vcom applied to the first common electrode ME1, is charged in the first liquid crystal capacitor Clc1. Accordingly, the first sub-pixel SPX1 is charged with the first pixel voltage.

The data voltage is applied to the second sub-pixel SPX2 through the turned-on second transistor TR2, and the storage voltage Vcst is applied to the second sub-pixel SPX2 through the turned-on third transistor TR3.

Figure 4A:
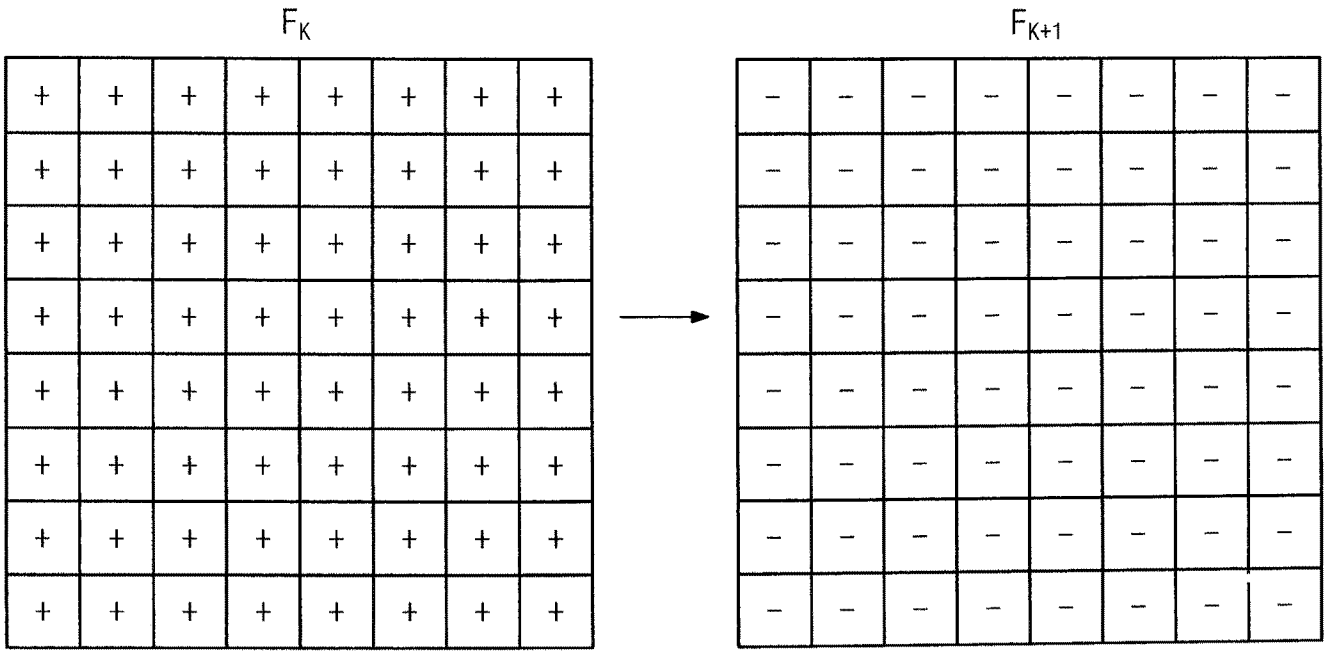
FIG. 4A is a view showing a frame inversion driving scheme of a display device according to an exemplary embodiment of the present disclosure.
Figure 4B:
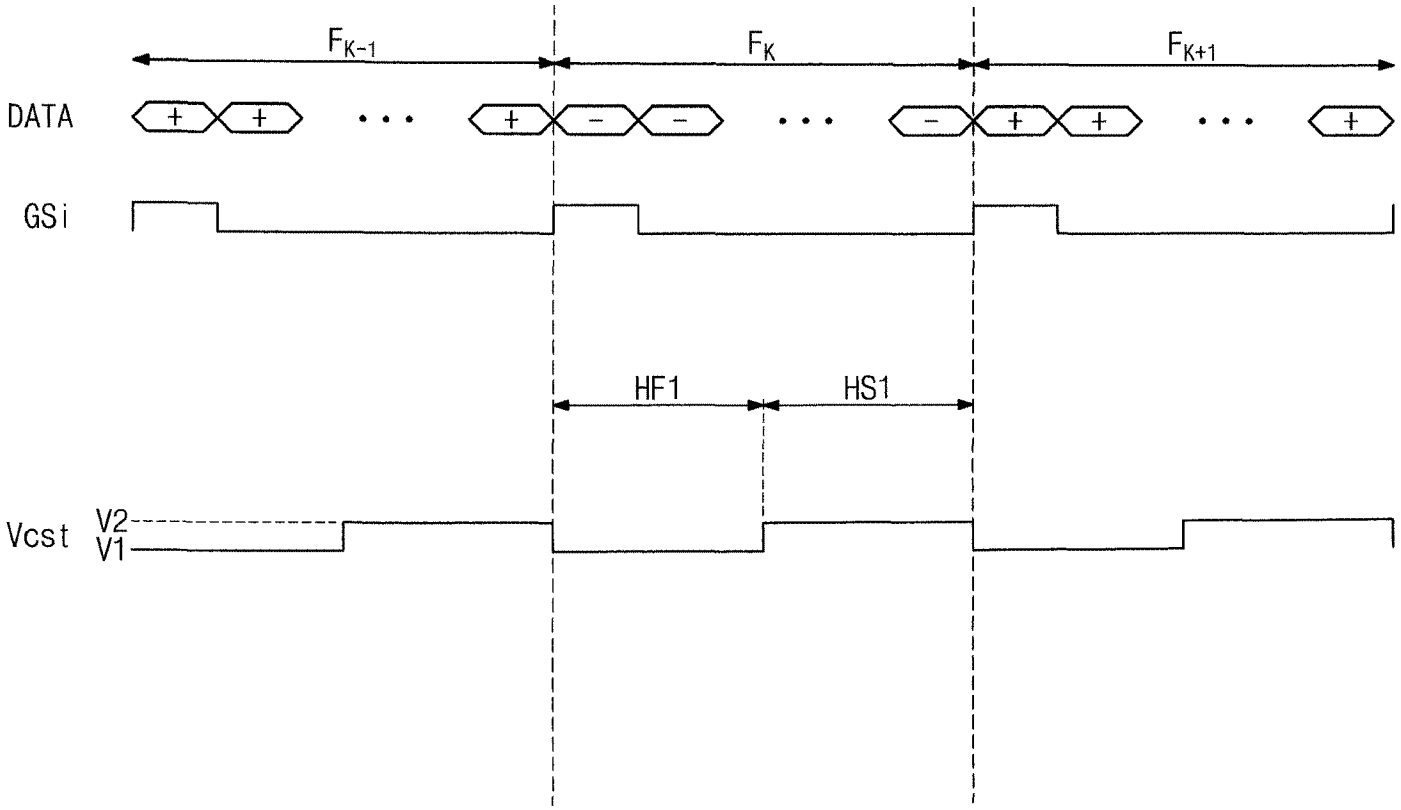
FIG. 4B is a timing diagram showing a frame inversion driving scheme of a display device according to an exemplary embodiment of the present disclosure.

The storage voltage Vcst swings between a first electric potential level V1 and a second electric potential level V2 (e.g., see FIG. 4B). The second electric potential level V2 is greater than the first electric potential level V1.

The data voltage has a range of voltage levels, which is set to be wider than a voltage level of the storage voltage Vcst. The common voltage Vcom has an intermediate value of the range of voltage level of the data voltage. An absolute value of a difference in voltage level between the data voltage and the common voltage Vcom is greater than an absolute value of a difference in voltage level between the storage voltage Vcst and the common voltage Vcom.

The second and third transistors are connected to each other in series. A contact voltage between the second and third transistors TR2 and TR3 is obtained by voltage-division using a resistance of each of the second and third transistors TR2 and TR3. That is, the contact voltage between the second and third transistors TR2 and TR3 has a value between the data voltage provided through the turned-on second transistor TR2 and the storage voltage Vcst provided through the third transistor TR3. The contact voltage between the second and third transistors TR2 and TR3 is applied to the second pixel electrode PE2. That is, the voltage corresponding to the value between the data voltage and the storage voltage Vcst is applied to the second pixel electrode PE2.

The second pixel voltage, which corresponds to the difference between the voltage applied to the second pixel electrode PE2 and the common voltage Vcom applied to the second common electrode ME2, is charged in the second liquid crystal capacitor Clc2. That is, the second pixel voltage, which is smaller than the first pixel voltage, is charged in the second liquid crystal capacitor Clc2. Therefore, the second sub-pixel SPX2 is charged with the second pixel voltage that is smaller than the first pixel voltage.

The first and second sub-pixels SPX1 and SPX2 display the images having different grayscale values due to the above-mentioned driving method, and thus, a visibility of the display device DD may be improved.

FIG. 4A is a view showing a frame inversion driving scheme of a display device according to an exemplary embodiment of the present disclosure, and FIG. 4B is a timing diagram showing a frame inversion driving scheme of a display device according to an exemplary embodiment of the present disclosure.

FIG. 4A shows a k-th frame period $F_k$ and a (k+1)th frame period $F_{k+1}$ among the frame periods. In addition, FIG. 4A shows sixty-four (64) pixels on the assumption that m is 8 and n is 8 in the present embodiment, and that each box corresponds to the pixel $PX_{ij}$ shown in FIG. 3.

The data voltages applied to the pixels during the k-th frame period $F_k$ have a positive polarity. On the contrary, the data voltages applied to the pixels during the (k+1)th frame period $F_{k+1}$ have a negative polarity. In the case of the frame inversion driving scheme, the data voltages applied to the pixels during one frame period have the same polarity, and the polarity of the data voltages is inverted during a next frame period.

Referring to FIGS. 3 and 4B, the storage voltage Vcst applied to the third output electrode OE3 of the third transistor TR3 swings between V1 and V2, and has a period that is the same as the frame period. For instance, in the case where the liquid crystal display device DD displays the frame periods at 60 Hz, a frequency of the storage voltage Vcst is 60 Hz.

The one period of the storage voltage Vcst is divided into a first earlier period (e.g., half period) HF1 and a first later period (e.g., half period) HS1. The first earlier period HF1 has substantially the same length as the first later period HS1. In the first earlier period HF1, the third transistor TR3 applies the storage voltage Vcst having the first electric potential level V1 to the second liquid crystal capacitor Clc2. In the first later period HS1, the third transistor TR3 applies the storage voltage Vcst having the second electric potential level V2, which is greater than the first electric potential level V1, to the second liquid crystal capacitor Clc2.

As described above, because the storage voltage Vcst, which changes once for every frame period, is applied to the third output electrode OE3 in the liquid crystal display device DD driven in the frame inversion driving scheme, a voltage drop generated by a storage line extending from the storage electrodes STE1 and STE2 (i.e., an IR drop) may be reduced or prevented from occurring.

Figure 5A:
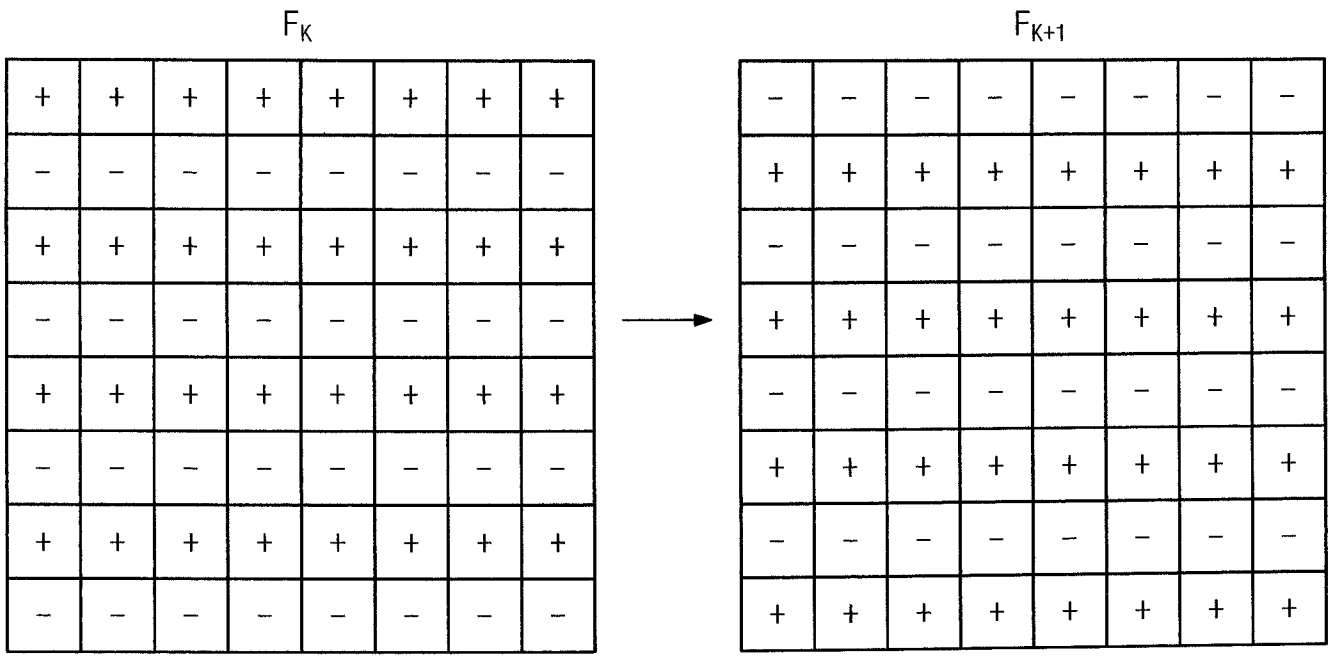
FIG. 5A is a view showing a line inversion driving scheme of a display device according to an exemplary embodiment of the present disclosure.
Figure 5B:
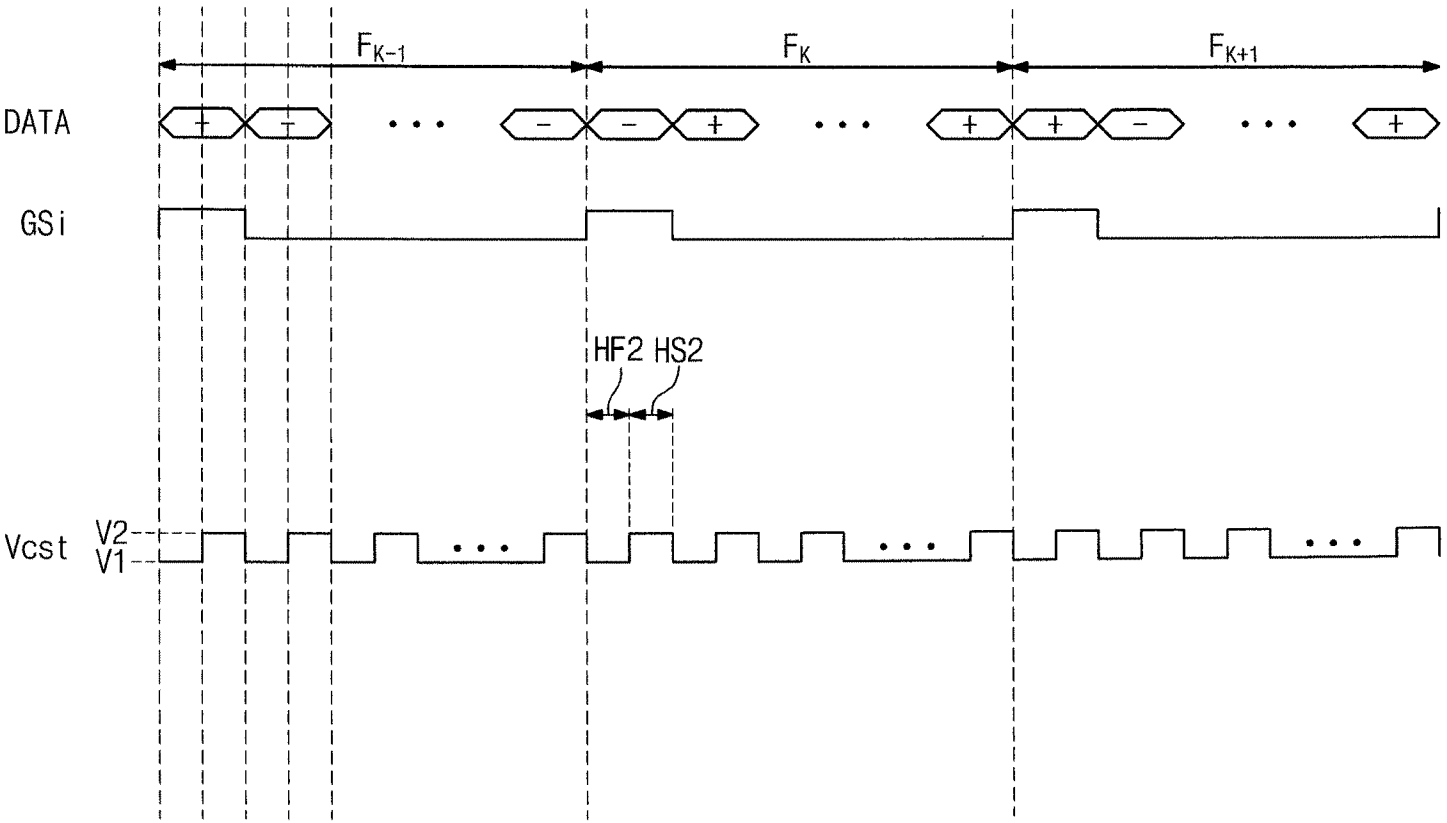
FIG. 5B is a timing diagram showing a line inversion driving scheme of a display device according to an exemplary embodiment of the present disclosure.

FIG. 5A is a view showing a line inversion driving scheme of a display device according to an exemplary embodiment of the present disclosure, and FIG. 5B is a timing diagram showing a line inversion driving scheme of a display device according to an exemplary embodiment of the present disclosure.

FIG. 5A shows a k-th frame period $F_k$ and a (k+1)th frame period $F_{k+1}$ among the frame periods. In addition, FIG. 5A shows sixty-four (64) pixels on the assumption that m is 8 and n is 8, and each box corresponds to the pixel $PX_{ij}$ shown in FIG. 3.

The m×n pixels are divided into m pixel rows and n pixel columns. In the line inversion driving scheme, the polarity of the data voltages applied to the pixels is inverted for every pixel row. Thus, the polarity of the data voltages applied to one pixel row among the pixel rows is different from the polarity of the data voltages applied to a pixel row that is adjacent the one pixel row.

Referring to FIG. 5A, the data voltages applied to the pixels arranged in odd-numbered rows during the k-th frame period $F_k$ have the positive polarity, and the data voltages applied to the pixels arranged in even-numbered rows during the k-th frame period $F_k$ have the negative polarity. On the contrary, the data voltages applied to the pixels arranged in the odd-numbered rows during the (k+1)th frame period $F_{k+1}$ have the negative polarity, and the data voltages applied to the pixels arranged in even-numbered rows during the (k+1)th frame period $F_{k+1}$ have the positive polarity.

Referring to FIGS. 3 and 5B, the storage voltage Vcst applied to the third output electrode OE3 of the third transistor TR3 swings at m periods for every frame period. For instance, when the liquid crystal display device DD displays the frame periods at 60 Hz, a frequency of the storage voltage Vcst is m×60 Hz.

Each of the m periods of the storage voltage Vcst is divided into a second earlier period HF2 and a second later period HS2. The second earlier period HF2 has substantially the same length as the second later period HS2. In the second earlier period HF2, the third transistor TR3 applies the storage voltage Vcst having the first electric potential level V1 to the second liquid crystal capacitor Clc2. In the second later period HS2, the third transistor TR3 applies the storage voltage Vcst having the second electric potential level V2, which is greater than the first electric potential level V1, to the second liquid crystal capacitor Clc2.

As described above, because the storage voltage Vcst swung at m periods for every frame period is applied to the third output electrode OE3 in the liquid crystal display device DD driven in the line inversion driving scheme, a voltage drop generated by a storage line extending from the storage electrodes STE1 and STE2 (i.e., an IR drop) may be reduced or prevented from occurring.

Figure 6B:
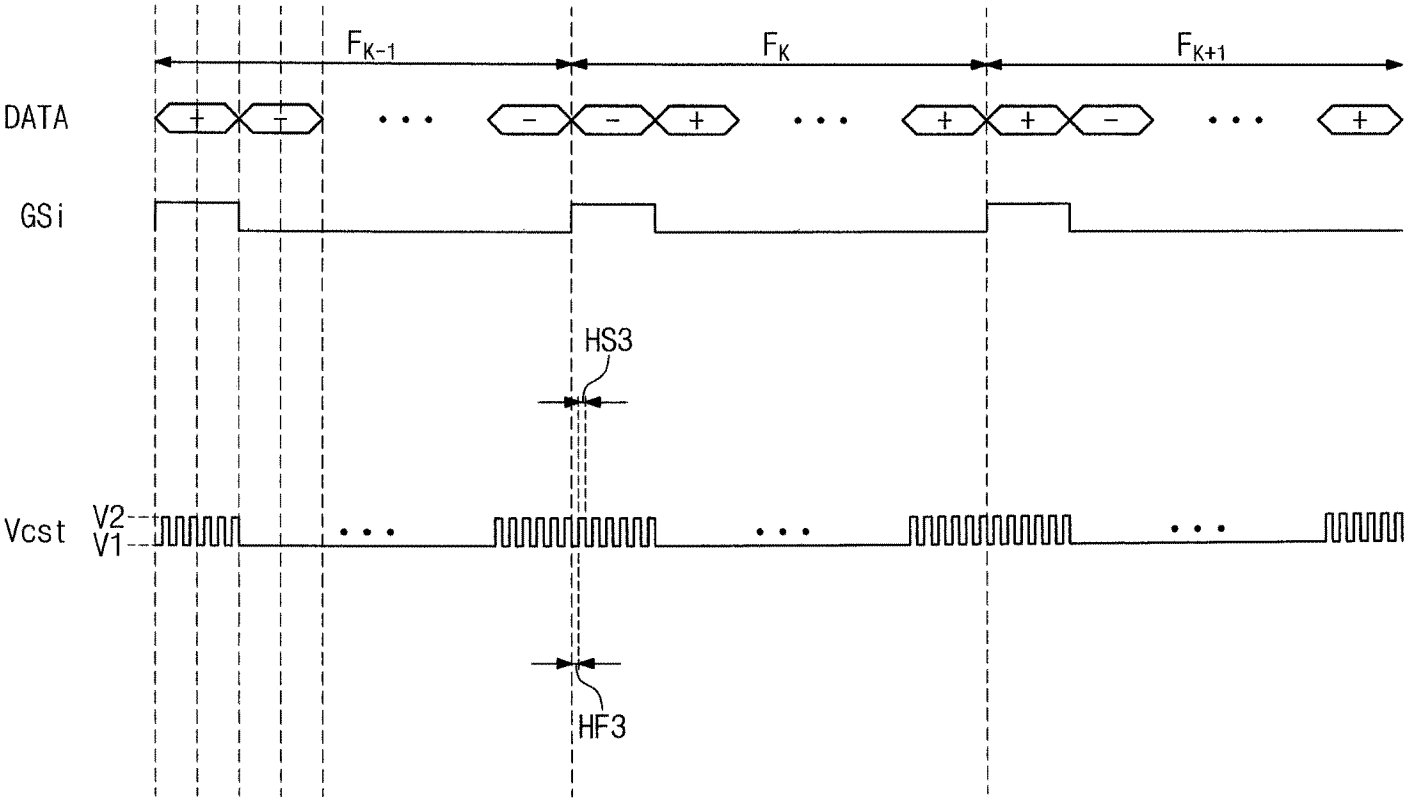
FIG. 6B is a timing diagram showing a dot inversion driving scheme of a display device according to an exemplary embodiment of the present disclosure.

FIG. 6A is a view showing a dot inversion driving scheme of a display device according to an exemplary embodiment of the present disclosure, and FIG. 6B is a timing diagram showing a dot inversion driving scheme of a display device according to an exemplary embodiment of the present disclosure.

FIG. 6A shows a k-th frame period $F_k$ and a (k+1)th frame period $F_{k+1}$ among the frame periods. In addition, FIG. 6A shows sixty-four (64) pixels on the assumption that m is 8 and n is 8, and each box corresponds to the pixel $PX_{ij}$ shown in FIG. 3.

The m×n pixels receive data voltages dot-inverted at every frame period. Each of the m×n pixels is applied with the data voltage having a different polarity from that of pixels adjacent thereto (e.g., adjacent in horizontal or vertical directions). In addition, the polarity of the data voltage applied to each of the m×n pixels is inverted every frame period.

Referring to FIGS. 3 and 6B, the storage voltage Vcst applied to the third output electrode OE3 of the third transistor TR3 swings at m×n periods for every frame period. For instance, when the liquid crystal display device DD displays the frame periods at 60 Hz, a frequency of the storage voltage Vcst is m×n×60 Hz.

Each of the m×n periods of the storage voltage Vcst is divided into a third earlier period HF3 and a third later period HS3. The third earlier period HF3 has substantially the same length as the third later period HS3. In the third earlier period HF3, the third transistor TR3 applies the storage voltage Vcst having the first electric potential level V1 to the second liquid crystal capacitor Clc2. In the third later period HS3, the third transistor TR3 applies the storage voltage Vcst having the second electric potential level V2, which is greater than the first electric potential level V1, to the second liquid crystal capacitor Clc2.

As described above, because the storage voltage Vcst swung at m×n periods for every frame period is applied to the third output electrode OE3 in the liquid crystal display device DD driven in the dot inversion driving scheme, a voltage drop generated by a storage line extending from the storage electrodes STE1 and STE2 (i.e., an IR drop) may be reduced or prevented from occurring.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed by the following claims and their equivalents.

What is claimed is:

1. A liquid crystal display panel comprising:
m gate lines (m being a positive integer);
n data lines(n being a positive integer); and
m×n pixels each connected to a corresponding gate line of them gate lines, each connected to a corresponding data line of the n data lines, and each comprising a first sub-pixel and a second sub-pixel,
wherein the first sub-pixel comprises:
a first liquid crystal capacitor; and
a first transistor configured to receive a data signal from the corresponding data line, and configured to apply the data signal to the first liquid crystal capacitor, and
wherein the second sub-pixel comprises:
a second liquid crystal capacitor;
a second storage capacitor comprising:
a second pixel electrode configured to receive the data signal or a storage voltage; and
a second storage electrode configured to receive the storage voltage;
a second transistor configured to apply the data signal to the second liquid crystal capacitor and to the second storage capacitor; and
a third transistor configured to apply the storage voltage, which is configured to swing between a first electric potential level and a second electric potential level that is greater than the first electric potential level, to the second liquid crystal capacitor and to the second storage capacitor,
wherein the data signal has a polarity inverted every frame period,
wherein the data signal applied to the m×n pixels at one period for every frame period has a same polarity, and
wherein the storage voltage swings at one period for every frame period at a frequency that is greater than a frequency at which the data signal has the polarity inverted.

2. The liquid crystal display panel of claim 1, wherein each of the first, second, and third transistors comprises a control electrode connected to the corresponding gate line.

3. The liquid crystal display panel of claim 2, wherein the third transistor is connected to the second transistor in series.

4. The liquid crystal display panel of claim 1, wherein the first sub-pixel further comprises a first storage capacitor.

5. The liquid crystal display panel of claim 4, wherein the first storage capacitor comprises:
a first pixel electrode configured to receive the data signal; and
a first storage electrode configured to receive the storage voltage.

6. The liquid crystal display panel of claim 1, wherein the one period comprises:
an earlier period in which the third transistor applies the storage voltage having the first electric potential level to the second liquid crystal capacitor; and
a later period in which the third transistor applies the storage voltage having the second electric potential level to the second liquid crystal capacitor.

7. The liquid crystal display panel of claim 6, wherein the m×n pixels are divided into m pixel rows and n pixel columns, the m pixel rows being configured to receive the data signals, which are configured to be line-inverted every frame period.

8. The liquid crystal display panel of claim 7, wherein the storage voltage is configured to swing at each of m periods for every frame period.

9. The liquid crystal display panel of claim 8, wherein each of the m periods comprises:
an earlier period in which the third transistor is configured to apply the storage voltage having the first electric potential level to the second liquid crystal capacitor; and
a later period in which the third transistor is configured to apply the storage voltage having the second electric potential level to the second liquid crystal capacitor.

10. The liquid crystal display panel of claim 6, wherein the m×n pixels are configured to receive the data signals, which are configured to be dot-inverted every frame period.

11. The liquid crystal display panel of claim 10, wherein the storage voltage is configured to swing at m×n periods for every frame period.

12. The liquid crystal display panel of claim 11, wherein each of the m×n periods comprises:
an earlier period in which the third transistor is configured to apply the storage voltage having the first electric potential level to the second liquid crystal capacitor; and
a later period in which the third transistor is configured to apply the storage voltage having the second electric potential level to the second liquid crystal capacitor.

* * * * *